US010119553B2

(12) United States Patent
Son et al.

(10) Patent No.: US 10,119,553 B2
(45) Date of Patent: Nov. 6, 2018

(54) CENTRIFUGAL FAN

(71) Applicant: LG ELECTRONICS INC., Seoul (KR)

(72) Inventors: Sangyuk Son, Seoul (KR); Choonmyun Chung, Seoul (KR); Taeman Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 610 days.

(21) Appl. No.: 14/724,262

(22) Filed: May 28, 2015

(65) Prior Publication Data

US 2015/0345511 A1 Dec. 3, 2015

(30) Foreign Application Priority Data

May 28, 2014 (KR) ..... 10-2014-0064680

(51) Int. Cl.
*F04D 29/60* (2006.01)
*F04D 17/10* (2006.01)
(Continued)

(52) U.S. Cl.
CPC ..... *F04D 29/601* (2013.01); *F04D 17/10* (2013.01); *F04D 29/281* (2013.01);
(Continued)

(58) Field of Classification Search
CPC .... F04D 29/601; F04D 29/281; F04D 29/288; F04D 29/30; F04D 29/403; F04D 29/666; F04D 17/10
See application file for complete search history.

(56) References Cited

U.S. PATENT DOCUMENTS 1,447,915 A 3/1923 Watkins
4,357,914 A * 11/1982 Hauser ..... F01P 5/06 123/41.49
(Continued)

FOREIGN PATENT DOCUMENTS

CN 1840920 10/2006
CN 101960150 1/2011
(Continued)

OTHER PUBLICATIONS

European Search Report dated Oct. 20, 2015 issued in Application No. 15169372.8.
(Continued)

*Primary Examiner* — Richard Edgar
(74) *Attorney, Agent, or Firm* — KED & Associates, LLP

(57) ABSTRACT

A centrifugal fan includes a main plate rotating about an axis of rotation, a shroud having an inlet port for introduction of air, and a plurality of blades circumferentially arranged between the main plate and the shroud so as to form a flow of air by accelerating air introduced through the inlet port. Each blade has a pressure surface formed such that a portion thereof near to the shroud is convex and a portion thereof near to the main plate is concave. The shroud has an inside surface formed as a curved surface, and the curved surface has a diffusion section extending radially. The main plate has a curved surface extending radially, and a curved surface of the shroud in the diffusion section at least partially overlaps with the curved surface formed in the main plate when viewed in a direction of the axis of rotation.

9 Claims, 7 Drawing Sheets

(51) Int. Cl.

| | |
|---|---|
| ***F04D 29/40*** | (2006.01) |
| ***F04D 29/28*** | (2006.01) |
| ***F04D 29/30*** | (2006.01) |
| ***F04D 29/66*** | (2006.01) |

(52) U.S. Cl.
CPC ..... *F04D 29/288* (2013.01); *F04D 29/30* (2013.01); *F04D 29/403* (2013.01); *F04D 29/666* (2013.01)

(56) References Cited

U.S. PATENT DOCUMENTS

| | | | | |
|---|---|---|---|---|
| 6,039,539 | A * | 3/2000 | Berg | F04D 29/282 415/119 |
| 2012/0055656 | A1* | 3/2012 | Han | F04D 29/281 165/122 |
| 2015/0275922 | A1* | 10/2015 | Son | F04D 17/10 415/206 |

FOREIGN PATENT DOCUMENTS

| | | |
|---|---|---|
| CN | 203175972 U | 9/2013 |
| GB | 18349 | 6/1911 |
| WO | WO 97/09535 | 3/1997 |

OTHER PUBLICATIONS

Chinese Office Action dated Jan. 22, 2017 issued in Application No. 201510283524.0 (English translation attached).

* cited by examiner (a)

(b)

CENTRIFUGAL FAN

CROSS-REFERENCE TO RELATED APPLICATION

This application claims priority under 35 U.S.C. § 119 to Korean Patent Application No. 10-2014-0064680, filed on May 28, 2014 in the Korean Intellectual Property Office, whose entire disclosure is hereby incorporated by reference.

BACKGROUND

1. Field

The present disclosure relates to a centrifugal fan.

2. Background

A centrifugal fan is a fan for accelerating air axially introduced through a shroud to discharge the air through gaps between blades in a radial direction (or in a centrifugal direction). The performance of the centrifugal fan is influenced by various form factors besides fiction and shock losses. For example, the typical factors affecting the performance of the centrifugal fan include a rotational speed, a shape of a blade, main plate, or shroud, and the number or angles of blades.

In the centrifugal fan, after air is introduced through an inlet port formed at a central portion of the shroud and is accelerated by the blades, the air is discharged along an outer periphery of the shroud in an upper region near to the inlet port while being discharged along an outer periphery of the main plate in a lower region far from the inlet port. In this case, eddies are generated due to flow separation generated in the respective outer peripheries of the shroud and main plate in the related art, resulting in poor efficiency of the fan and noise generation.

In particular, since air introduced through the shroud is pressurized by the blades in the course of reaching the main plate in a direction of an axis of rotation and is then discharged, a difference in flow velocity is generated between the upper and lower regions. For this reason, the air is not uniformly discharged across the upper and lower regions. Particularly, there is a problem in that the fan has poor efficiency and noise increases due to eddies generated by the difference in flow velocity between the upper and lower regions.

BRIEF DESCRIPTION OF THE DRAWINGS

The embodiments will be described in detail with reference to the following drawings in which like reference numerals refer to like elements wherein.

DETAILED DESCRIPTION

Figure 1:
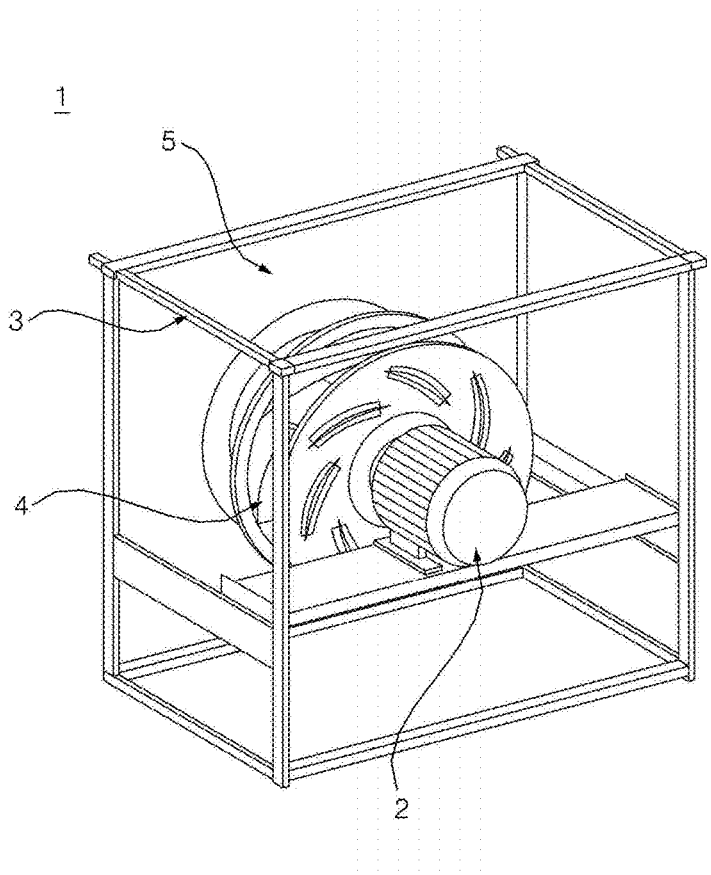
FIG. 1 is a view illustrating an example of a plug fan module to which a centrifugal fan is applied.

FIG. 1 is a view illustrating an example of a plug fan module to which a centrifugal fan is applied. A centrifugal fan according to exemplary embodiments described below may be generally applied to a refrigerator, an air conditioner, a cleaner, etc. Since air is naturally introduced into the fan and discharged to the outside, the fan may be installed without ducts. The plug fan module 1 illustrated in FIG. 1 is applied to an air conditioner which is installed to the exterior and cools or heats air introduced into the interior to supply the air to the interior again. A centrifugal fan according to an embodiment of the present disclosure may be applied to the plug fan module 1.

The fan module 1 may include a motor 2 having a rotary shaft, a support frame 3 for supporting the motor 2, and a centrifugal fan 4 coupled to the rotary shaft of the motor 2. In addition, a front panel 5 installed to a front surface of the support frame 3 has an opening portion such that air may be introduced into the centrifugal fan 4. Air introduced through the opening portion in a direction of an axis of rotation of the centrifugal fan 4 is discharged to the outside in a radial direction of the fan in a rear region of the front panel 5 along with rotation of the centrifugal fan 4.

Figure 2:
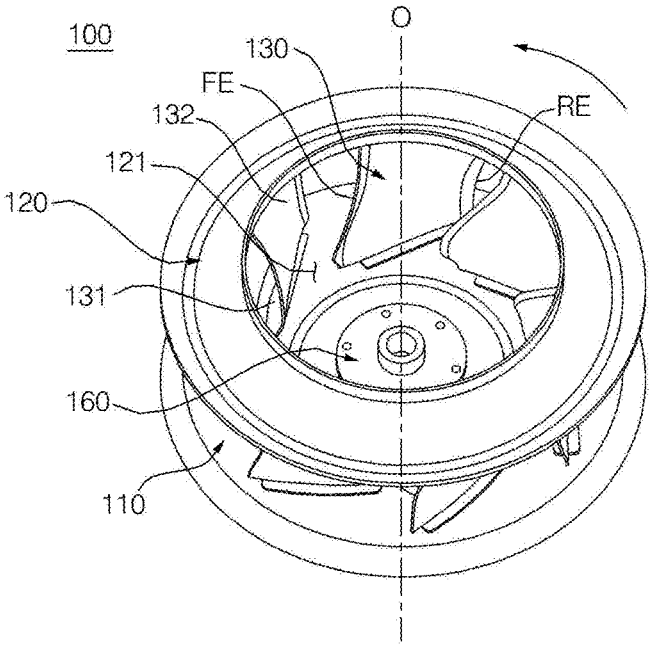
FIG. 2 is a perspective view illustrating a centrifugal fan according to an embodiment of the present disclosure.
Figure 3:
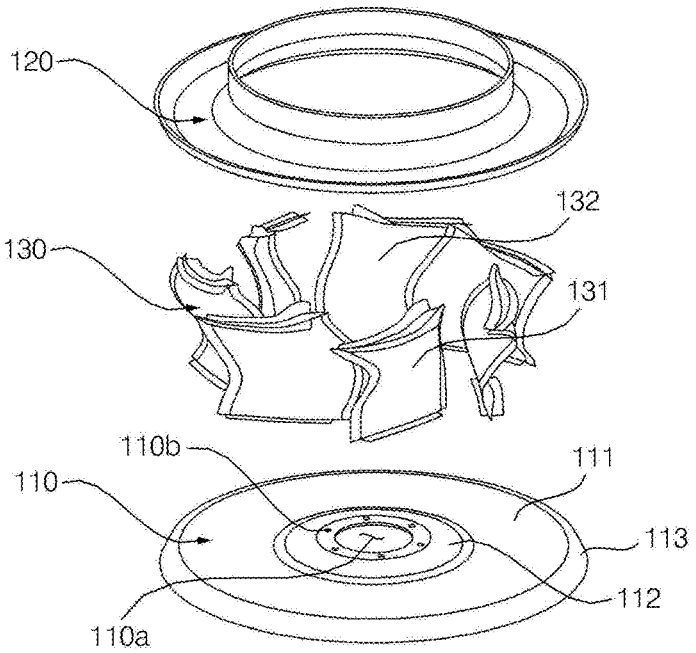
FIG. 3 is an exploded perspective view illustrating the centrifugal fan of FIG. 2.
Figure 4:
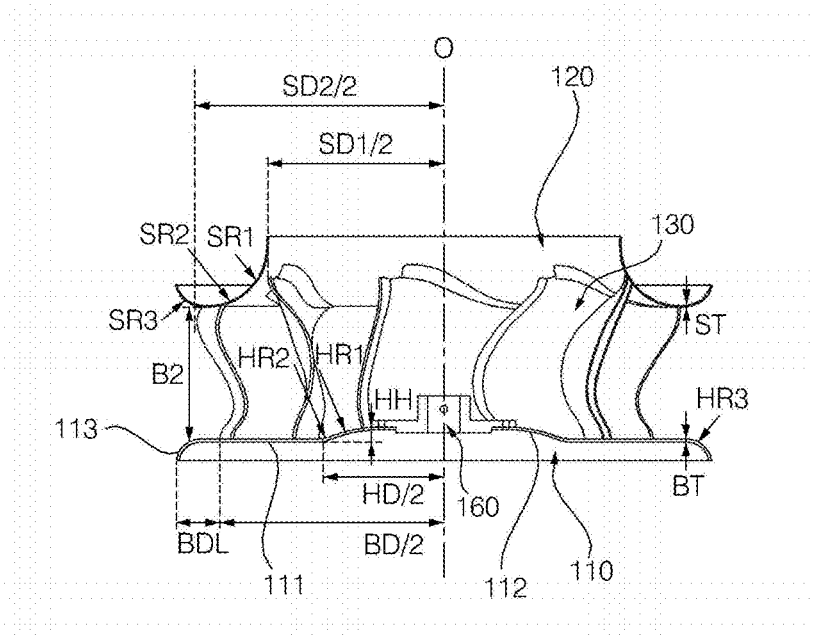
FIG. 4 is a view illustrating a state in which the centrifugal fan of FIG. 2 is longitudinally cut.
Figure 5:
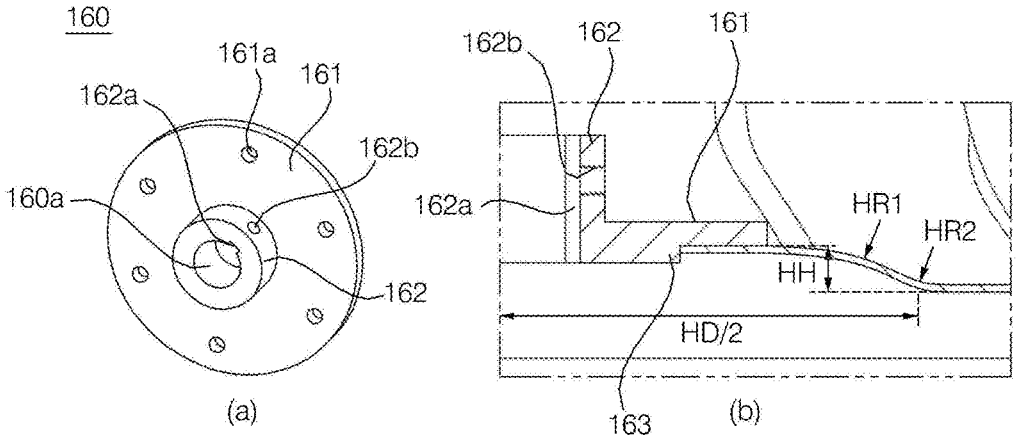
FIG. 5 is an enlarged view illustrating a structure in which each of (a) a hub and (b) a hub is coupled to a main plate.
Figure 6:
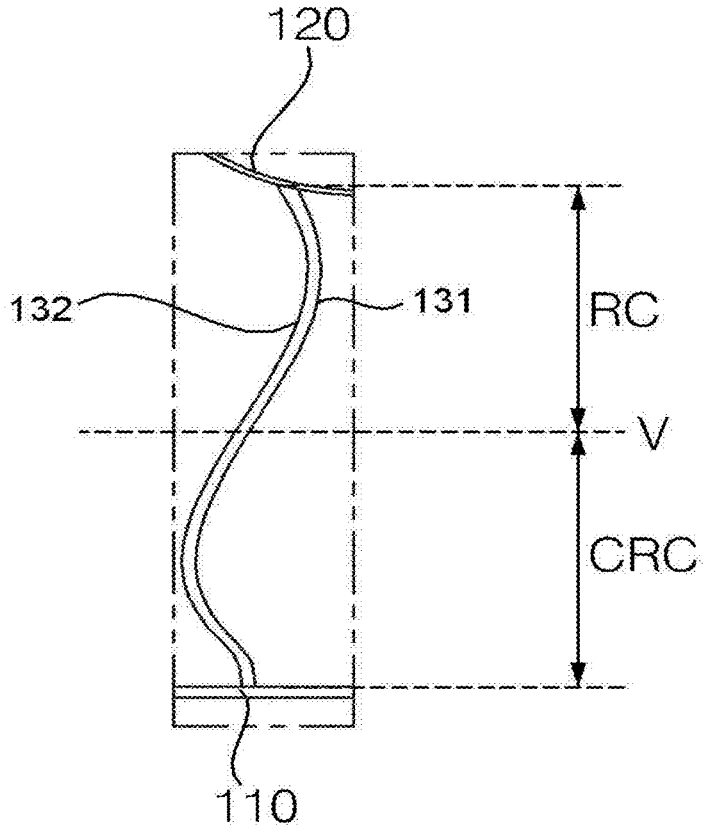
FIG. 6 is a longitudinal cross-sectional view of one blade.
Figure 7:
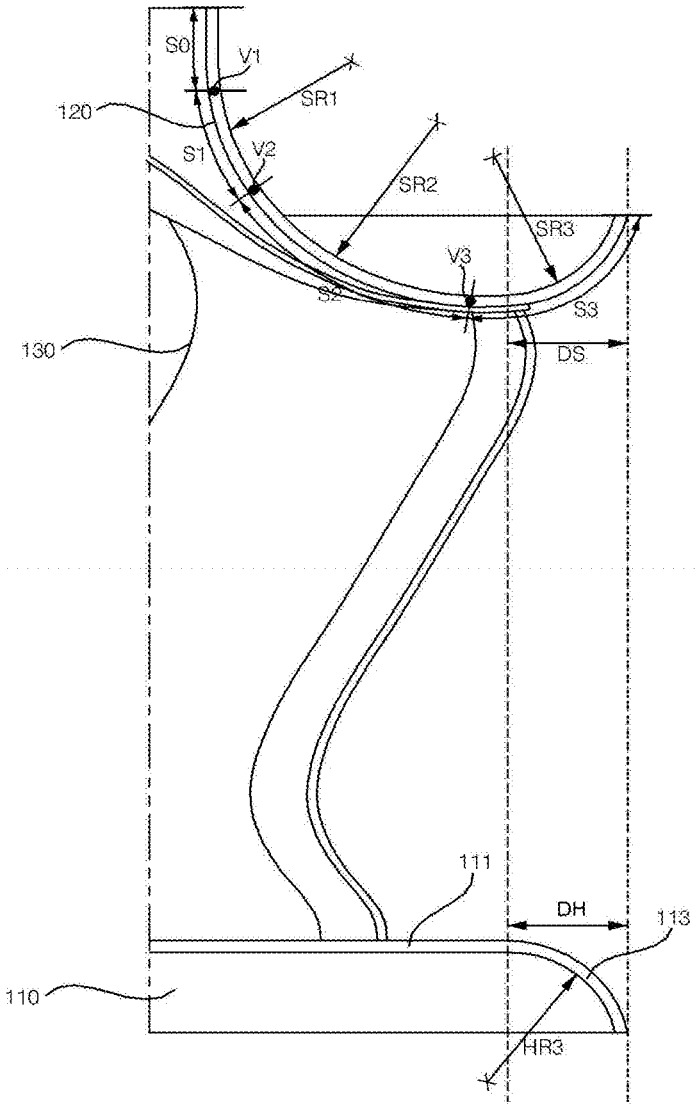
FIG. 7 is an enlarged view illustrating a portion in which an outer peripheral portion of a shroud and an outer peripheral portion of a main plate are shown in a cross section of the centrifugal fan cut in any plane to which an axis of rotation belongs.
Figure 8:
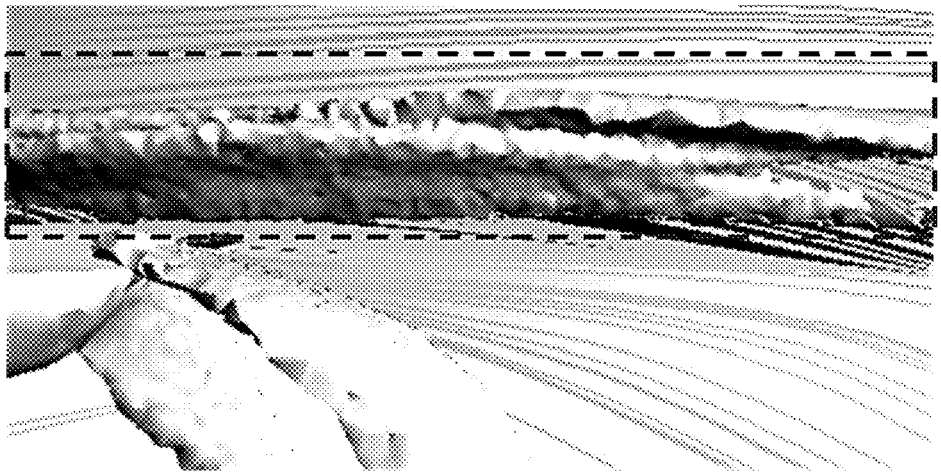
FIG. 8 is a comparative view of (a) an eddy generated in an outer peripheral portion of a shroud in a conventional centrifugal fan and (b) an eddy generated in the outer peripheral portion of the shroud in the centrifugal fan according to the embodiment of the present disclosure.
Figure 8:
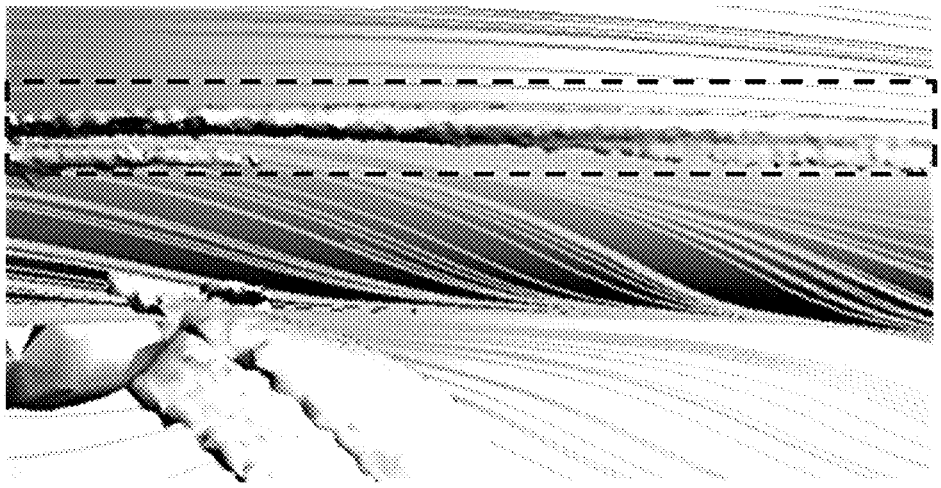

FIG. 2 is a perspective view illustrating a centrifugal fan according to an embodiment of the present disclosure. FIG. 3 is an exploded perspective view illustrating the centrifugal fan of FIG. 2. FIG. 4 is a view illustrating a state in which the centrifugal fan of FIG. 2 is longitudinally cut. FIG. 5 is an enlarged view illustrating a structure in which each of (a) a hub and (b) a hub is coupled to a main plate. FIG. 6 is a longitudinal cross-sectional view of one blade. FIG. 7 is an enlarged view illustrating a portion in which an outer peripheral portion of a shroud and an outer peripheral portion of a main plate are shown in a cross section of the centrifugal fan cut in any plane to which an axis of rotation belongs. FIG. 8 is a comparative view of (a) an eddy generated in an outer peripheral portion of a shroud in a conventional centrifugal fan and (b) an eddy generated in the outer peripheral portion of the shroud in the centrifugal fan according to the embodiment of the present disclosure.

Referring to FIGS. 2 to 4, the centrifugal fan, which is designated by reference numeral 100, according to the embodiment of the present disclosure includes a main plate 110, a shroud 120, and a plurality of blades 130. Each of the main plate 110, the shroud 120, and the blades 130 may be made of synthetic resin or a metal material having plasticity, and particularly, may be made of steel or metal materials.

The main plate 110 rotates about an axis of rotation O by a motor 2 (see FIG. 1). In the embodiment, the centrifugal fan 100 may further include a hub 160 which couples the main plate 110 to a rotary shaft of the motor although the main plate 110 may be directly connected to the rotary shaft of the motor.

The shroud 120 is spaced apart from the main plate 110 and has an inlet port 121 through which air is introduced in a direction of the axis of rotation O. The shroud 120 has a ring shape in which the inlet port 121 is formed at the center thereof. The shroud 120 has a shape extending radially from an inner periphery thereof defining the inlet port 121, thereby having a maximum diameter at an outer periphery thereof from which air transported by the blades 130 flows. The shroud 120 may have an inside surface which is convexly curved toward the main plate 110 for guiding air.

The blades 130 are circumferentially arranged between the main plate 110 and the shroud 120. Air introduced through the inlet port 121 of the shroud 120 flows from front edge portions of the blades 130 to rear edge portions thereof and is then discharged. As can be appreciated the centrifugal fan 100 may have more than seven blades 130.

In each blade 130, a portion with which air introduced through the shroud 120 begins to come into contact is referred to as "front edge FE" and a portion from which a flow of air is separated from the blade 130 is referred to as "rear edge RE". When any layer (or plane) orthogonal to the axis of rotation O is taken, the front edges FE are located on a predetermined first circle and the rear edges RE are located on a predetermined second circle having a greater diameter than the first circle, in cross sections of the blades 130 on the layer. When, in each blade 130, a surface which is directed outward of the centrifugal fan 100 is referred to as "pressure surface 131" and a surface which is an opposite surface of the pressure surface 131 while being directed inward of the centrifugal fan 100 is referred to as "suction surface 132", the front edge FE of the blade 130 is located in a direction in which the pressure surface 131 is directed (or in a rotation direction of the centrifugal fan 100), compared to the rear edge RE. The rear edge RE of the blade 130 may be located such that a point at which the rear edge RE meets the main plate 110 is closer to the axis of rotation O than a point at which the rear edge RE meets the shroud 120.

Referring to FIG. 6, when a predetermined longitudinal cross section parallel with the axis of rotation O is taken, the blade 130 has the pressure surface 131 formed such that a portion near to the shroud 120 is convex and a portion near to the main plate 110 is concave. The blade 130 has a portion RC which is convex in a direction away from the axis of rotation O (or in a direction in which the pressure surface 131 is directed) at an upper side of a predetermined inflection point V and a portion CRC which is convex toward the axis of rotation O (or in a direction in which the suction surface 132 is directed) at a lower side of the inflection point V. In other words, each portion of the pressure surface 131 is defined as follows: the convex curved portion of the pressure surface 131 is a convex portion RC and the concave curved portion of the pressure surface 131 is a concave portion CRC.

The concave portion CRC serves to entice a flow of air concentrated to the shroud 120 into the main plate 110. Consequently, a discharge velocity may be uniform across all of upper and lower regions of the blade 130 and it may be possible to reduce noise and improve efficiency of the fan.

Meanwhile, since a flow velocity is generally fast in a portion close to the shroud 120, flow inertia (particularly, a component in the direction of the axis of rotation O) is increased. Thus, the flow of air may be separated from the rear edge RE of the blade 130 when air is discharged. Particularly, flow separation tends to occur on the suction surface 132. Since the convex portion RC is a convex portion of the pressure surface 131, the convex portion RC serves to concentrate a flow of air toward the suction surface 132 of another blade 130, thereby enabling the flow separation to be suppressed. Particularly, since the convex portion RC is formed at a portion close to the shroud 120, the flow separation may be effectively suppressed in a portion near to the shroud 120 from among portions of the rear edge RE of the blade 130.

The concave portion CRC serves to entice a flow of air concentrated to the shroud 120 into the main plate 110. Consequently, a difference in flow velocity between the upper region of the blade 130 close to the shroud 120 and the lower region of the blade 130 close to the main plate 110 is decreased, and thus a discharge velocity may be uniform across all of the upper and lower regions.

Referring to FIGS. 3 to 7, the main plate 110 includes a blade support plate portion 111 which supports a lower end portion and a hub mounting portion 112 which is formed at the center of the blade support plate portion 111 and protrudes toward the shroud 120 from the blade support plate portion 111. The hub mounting portion 112 has an opened mounting hole 110*a* formed at the center thereof such that the hub 160 may be mounted to the mounting hole 110*a*. The hub mounting portion 112 has a plurality of first fastening holes 110*b* circumferentially formed around the mounting hole 110*a* at regular intervals.

The blade support plate portion 111 may be flat and a curved surface 113 may be formed to extend outward from the blade support plate portion 111.

Referring to FIG. 5, the hub 160 has an insertion hole 160*a* formed at the center thereof for insertion of the rotary shaft (not shown) of the motor, a hub body portion 161 seated on the hub mounting portion 112, and a first tubular protrusion portion 162 protruding around the insertion hole 160*a* from the hub body portion 161.

The hub body portion 161 has second fastening holes 161*a* corresponding to the first fastening holes 110*b*, and the first fastening holes 110*b* are fastened to the second fastening holes 161*a* by fastening members such as screws or bolts so that the hub 160 is coupled to the main plate 110.

The first tubular protrusion portion 162 may have a key insertion groove 162*a* formed on an inner peripheral surface thereof such that a key formed on the rotary shaft of the motor is inserted into the key insertion groove 162*a*. In addition, the first tubular protrusion portion 162 may have a key fastening hole 162*b* through which a fastening member fastened to a fastening hole (not shown) formed on the key is radially penetrated. The first protrusion portion 162 may have a thread formed along the key fastening hole 162*b*.

The hub 160 may further include a second tubular protrusion portion 163 which protrudes around the insertion hole 160*a* from the hub body portion 161 in a direction opposite to the first protrusion portion 162. The second protrusion portion 163 is inserted into the mounting hole 110*a* of the hub mounting portion 112, and has a diameter which is substantially equal to that of the mounting hole 110*a*.

Meanwhile, a height HH of the hub mounting portion 112 protruding from the blade support plate portion 111 and a curvature of the hub mounting portion 112 are main factors for the efficiency of the fan and interact with each other. Since the height of the hub mounting portion 112 acts against a flow of introduced air, a flow rate is reduced as the height of the hub mounting portion 112 is increased. However, when the height is properly formed in consideration of interaction with the curvature of the hub mounting portion 112, the flow of air is improved and the efficiency of the fan is enhanced.

The hub mounting portion 112 has a horizontal surface at a portion coming into contact with a back surface of the hub body portion 161. However, the hub mounting portion 112 has a portion bent from an outer end of the horizontal surface by a first curvature (1/HR1) and a portion of the hub mounting portion 112 connected to the blade support plate portion 111 has a second curvature (1/HR2) in a direction opposite to the first curvature (1/HR1). For reference, reference numeral HD/2 refers to a radius of the hub mounting portion 112.

The curved surface 113 is formed in an outer peripheral portion of the main plate 110, from which a flow of discharged air is separated, so as to be gradually away from the shroud 120 until reaching the outer periphery along a radial direction of the main plate 110. In more detail, the blade support plate portion 111 has a flat surface to which the blade 130 is connected. The curved surface 113 is a surface bent from the blade support plate portion 111 to the outer periphery of the main plate 110 in a downward direction (in a direction away from the shroud 120) by a predetermined curvature (1/HR3, reference numeral HR3 being a radius of curvature). Since a flow of air is smoothly guided along the curved surface 113 when air is discharged according to rotation of the centrifugal fan 100, it may be possible to suppress eddies from being generated in the outer periphery of the main plate 110 from which the flow of discharged air is separated and to reduce resistance.

Reference numeral BD/2 refers to a blowing radius of the main plate 110, is a distance from the center O of the main plate 110 to the rear edge RE of the blade 130, and is a measured value at a connection portion between the blade 130 and the main plate 110. Reference numeral BDL refers to a length of a region in which the flow of air separated from the rear edge RE of the blade 130 is guided, and is a distance from the rear edge RE of the blade 130 to the outer periphery of the main plate 110 in the radial direction.

Referring to FIG. 7, the inside surface of the shroud 120 is formed as a curved surface which is convex toward the main plate 110 for guiding a flow of air. The curved surface 113 has a diffusion section DS in an outer peripheral portion of the shroud 120 from which the flow of discharged air is separated, and the diffusion section DS extends so as to be gradually away from the main plate 110 to the outer periphery of the shroud 120.

At least a portion of the curved surface 113 formed in the main plate 110 overlaps with the diffusion section DS when viewed in the direction of the axis of rotation O. Since the flow of air is smoothly guided not only along the should 120 but also along the curved surface 113 in the main plate 110 in the outer peripheral portion of the centrifugal fan 100 with which the diffusion section DS overlaps, generation of eddies in the respective outer peripheries of the shroud 120 and the main plate 110 is reduced and thus noise is reduced.

As illustrated in FIG. 7, along a radially outward direction, a point at which the diffusion section DS begins in the shroud 120 and a point at which the curved surface 113 begins in the main plate 110 may be located at equal distance from the axis of rotation O, but the present disclosure is not necessarily limited thereto. The beginning positions of the curved surface 113 may differ from each other in consideration of flow characteristics in the shroud 120 and the main plate 110 varied according to the shapes of the convex portion RC and the concave portion CRC. However, the entire portion or a portion of the curved surface 113 formed in the main plate 110 is preferably located within a section DH corresponding to the diffusion section DS.

Air may be transported at a sufficient pressure by the concave portion CRC in the main plate 110, and air flowing along the main plate 110 may flow to the section DH corresponding to the diffusion section DS at a sufficient velocity. Accordingly, since at least a portion of the curved surface 113 of the main plate 110 overlaps with the diffusion section DS when viewed in the direction of the axis of rotation O, the flow of discharged air may be improved in the shroud 120 and the main plate 110 within the diffusion section DS or DH and the flow may be uniform within the above diffusion section in the shroud 120 and the main plate 110.

Particularly, according to various tests, it may be seen that the fan is most efficient when a curvature (1/SR3) of a curved surface in the diffusion section DS of the shroud 120 is equal to the curvature (1/HR3) of the curved surface 113 of the main plate 110.

The curved surface of the shroud 120 may have a uniform curvature, but preferably has several variable curvatures. In the embodiment, when the inside surface of the shroud 120 is formed as a curved surface and extends from the inlet port 121, the inside surface of the shroud 120 has a first curved portion S1 having a first curvature (1/SR1), a second curved portion S2 having a second curvature (1/SR2), and a third curved portion S3 having a third curvature (1/SR3), which are continuously formed in turn. The diffusion section DS may belong to the third curved portion S3. The first, second, and third curvatures (1/SR1, 1/SR2, and 1/SR3) may have different values. Preferably, the second curvature (1/SR2) is smaller than the first curvature (1/SR1) and the third curvature (1/SR3) is greater than the first curvature (1/SR1) (SR2>SR1>SR3, each of reference numerals SR1, SR2, and SR3 being a radius of curvature).

The first, second, and third curved portions S1, S2, and S3 are formed on the curved surface having a continuously varied gradient. Each of reference numerals V1, V2, and V3 in FIG. 7 refers to a point at which the curvature is changed (hereinafter, referred to as "curvature change point"), and the curvature of the curved surface is changed before and after the curvature change points. In this case, the gradient of the curved surface is continuously changed. Since the first and third curved portions S1 and S3 have different curvatures, the inside surface of the shroud 120 should have at least two curvature change points V2 and V3 in order to smoothly interconnect the first and third curved portions S1 and S3.

Meanwhile, the second curved portion S2 preferably has the longest curve length, compared to the first and third curved portions S1 and S3. Radial flow of air may be improved by lengthening a section in which the flow of air is radially guided.

The first curved portion S1 may directly extend from the inlet port 121. However, the first curved portion S1 may extend from an inlet portion S0 formed to a predetermined section from the inlet port 121, as illustrated in FIG. 7. The inlet portion S0 need not be formed as a curved surface, and is a section in which a flow of air in the inlet port 121 is substantially guided in the direction of the axis of rotation O. Even though the inlet portion S0 is formed as a curved surface, the curvature of the inlet portion S0 is relatively very small compared to other sections.

In particular, the inlet portion S0 at which is the inlet port 121 is formed and the outer peripheral portion S3 from which the flow of discharged air is separated may be formed by different curvatures. In this case, the inlet portion S0 is connected to the outer peripheral portion S3 by the curved surfaces S1 and S2. Accordingly, even though the inlet portion S0 and the outer peripheral portion S3 are formed by different curvatures in consideration of flow characteristics in the inlet port 121 and the outer periphery of the shroud 120 from which air flows, the inlet portion S0 and the outer peripheral portion S3 may be smoothly interconnected. Consequently, air may smoothly flow and the fan may have improved efficiency.

Reference numeral SD1/2 refers to a radius of the inlet port 121 (here, reference numeral SD1 being a diameter). Reference numeral SD2/2 refers to a distance from the center O of the shroud 120 to the rear edge RE of the blade 130 and is a measured value at a connection portion between the blade 130 and the shroud 120.

Considering the structure of the shroud 120 having the inside surface formed as a curved surface, a vertical distance between the main plate 110 and an upper end portion of the blade 130 coming into contact with the shroud 120 has a maximum value in the front edge FE of the blade 130 and a minimum value B2 in the rear edge RE of the blade 130. Hereinafter, the distance between the shroud 120 and the main plate 110 in the front edge FE is referred to as "B1".

A ratio (SD1/BD) of a suction diameter SD1 of the shroud 120 to a blowing diameter BD of the main plate 110 and a ratio (B2/B1) of the minimum value B2 to the maximum value B1 of the vertical distance between the upper end portion of the blade 130 and the main plate 110 are factors which may contribute to improvement in static pressure of the fan. Particularly, since the plug fan module does not have ducts, it is critical to optimize the factors for increasing the static pressure.

The static pressure is increased as the ratio (SD1/BD) is increased, but there is a limit in increasing the ratio to a certain level due to a limited size of an apparatus to which the centrifugal fan is installed. In addition, the static pressure is increased as the ratio (B2/B1) is increased, but the flow separation may be generated in the outer periphery of the shroud 120 and thus the performance of the fan may be deteriorated.

In accordance with the centrifugal fan of the present disclosure, it may be possible to suppress eddies from being generated in the respective outer peripheries of the shroud and the main plate from which the flow of discharged air is separated.

In addition, the flow of air may be uniform in the upper region near to the shroud and the lower region near to the main plate.

In addition, even though the inner peripheral portion at which the inlet port is formed and the outer peripheral portion from which air flows have different curvatures, the inner peripheral portion and the outer peripheral portion may be smoothly interconnected. Consequently, the flow of air may be smoothly guided and the fan may have improved efficiency.

In addition, the centrifugal fan of the present disclosure may have improved efficiency, compared to the conventional centrifugal fan.

In addition, the centrifugal fan of the present disclosure may have reduced noise, compared to the conventional centrifugal fan.

In addition, the flow of air may be more smoothly guided along the inside surface of the shroud.

A centrifugal fan generates a uniform flow in an upper region near to a shroud and a lower region near to a main plate, and suppresses eddies from being generated in respective outer peripheries of the shroud and main plate from which air is discharged.

A centrifugal fan allows air introduced through an inlet port to more smoothly flow along an inner peripheral surface of a shroud, compared to a conventional centrifugal fan.

A centrifugal fan has improved efficiency, compared to a conventional centrifugal fan.

A centrifugal fan has reduced noise, compared to a conventional centrifugal fan.

A centrifugal fan includes a main plate rotating about an axis of rotation, a shroud having an inlet port for introduction of air, and a plurality of blades circumferentially arranged between the main plate and the shroud so as to form a flow of air by accelerating air introduced through the inlet port, each having a pressure surface formed such that a portion thereof near to the shroud is convex and a portion thereof near to the main plate is concave, wherein the shroud has an inside surface formed as a curved surface which is convex toward the main plate, for guiding the flow of air, the curved surface has a diffusion section extending radially so as to be gradually away from the main plate to an outer periphery of the shroud, the main plate has a curved surface extending radially so as to be gradually away from the shroud to an outer periphery of the main plate, and a curved surface of the shroud in the diffusion section at least partially overlaps with the curved surface formed in the main plate when viewed in a direction of the axis of rotation.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A centrifugal fan comprising:

a main plate rotating about an axis of rotation;

a shroud having an inlet port for introduction of air; and a plurality of blades arranged between the main plate and the shroud, each blade having a pressure surface which is directed outward of the centrifugal fan, the pressure surface including a convex portion formed near the shroud and a concave portion formed near the main plate, wherein the shroud has an inside surface formed as a curved surface, which is convex toward the main plate, for guiding the flow of air, the curved surface being a diffusion section extending radially so as to gradually curve away from the main plate to an outer periphery of the shroud, and the main plate has a curved surface extending radially so as to gradually curve away from the shroud to an outer periphery of the main plate, the curved surface of the shroud in the diffusion section at least partially overlapping with the curved surface formed in the main plate when viewed in a direction of the axis of rotation.

2. The centrifugal fan according to claim 1, wherein a distance from the axis of rotation to the outer periphery of the shroud is equal to a distance from the axis of rotation to the outer periphery of the main plate.

3. The centrifugal fan according to claim 1, wherein the main plate includes a flat support plate to which the blades are installed, the curved surface of the main plate being formed in the main plate extends from the flat support plate.

4. The centrifugal fan according to claim 3, wherein each of the blades has a rear edge from which the air is discharged, the rear edge being formed such that a point at which the rear edge meets the main plate is closer to the axis of rotation than a point at which the rear edge meets the shroud.

5. The centrifugal fan according to claim 1, wherein the curved surface formed in the shroud has a first curved portion of a first curvature, a second curved portion of a second curvature, and a third curved portion of a third curvature, which are formed in sequence along a radially outward direction, the diffusion section being provided to the third curved portion; and the second curvature is smaller than the first curvature, and the third curvature is greater than the first curvature.

6. The centrifugal fan according to claim 5, wherein the curved surface of the shroud has a continuously varied gradient.

7. The centrifugal fan according to claim 5, wherein a length of the second curved portion is greater than the first and third curved portions.

8. The centrifugal fan according to claim 1, wherein the curved surface formed in the diffusion section and the curved surface formed in the main plate have the same curvature.

9. The centrifugal fan according to claim 1, wherein the shroud has two or more curvature change points at which a curvature is changed in a cross section cut in any plane to which the axis of rotation belongs.

* * * * *